United States Patent [19]

Sullivan et al.

[11] Patent Number: 4,964,356

[45] Date of Patent: Oct. 23, 1990

[54] UNDERWATER TOWED BODY STABILIZING DEVICE

[75] Inventors: Michael J. Sullivan; Douglas G. Dussault, both of Oakdale; Daniel Dinsmore, Jr., East Lyme, all of Conn.

[73] Assignee: The United States of America as represented by the Secretary of the Navy, Washington, D.C.

[21] Appl. No.: 373,539

[22] Filed: Jun. 22, 1989

[51] Int. Cl.[5] ..... B63B 39/02; B63B 21/66

[52] U.S. Cl. ..... 114/244; 114/124; 114/253

[58] Field of Search ..... 114/244, 245, 253, 124

[56] References Cited

U.S. PATENT DOCUMENTS

| | | | |
|---|---|---|---|
| 1,387,665 | 8/1921 | Ring | 114/124 |
| 2,411,156 | 11/1946 | Grimminger | 114/244 |
| 2,995,103 | 8/1961 | Waas et al. | 114/124 |
| 3,375,800 | 4/1968 | Cole et al. | 114/245 |
| 4,014,280 | 3/1977 | Laxo | 114/124 |

*Primary Examiner*—David H. Brown

*Attorney, Agent, or Firm*—Michael J. McGowan; Prithvi C. Lall

[57] ABSTRACT

A stabilizing device for an underwater towed body includes a vertically movable keel inside the towed body using an electric motor. Major part of the imbalanced torque of the tow cable provides rotation of the towed body. A final correction of the rolling motion of the towed body is accomplished by moving a keel weight housed inside the towed body. The extension of the keel weight is controlled by the power applied to the electric motor which is controlled from the surface ship. A sensor sends rolling motion information to the surface ship via the tow cable.

6 Claims, 1 Drawing Sheet

UNDERWATER TOWED BODY STABILIZING DEVICE

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

Subject invention is related to underwater towed bodies and more particularly to an apparatus and method for stabilizing an underwater towed body by correcting for its rolling motion.

(2) Description of the Prior Art

Traditionally, an underwater towed body is stabilized against its rolling motion caused by the tow cable torque. This is accomplished by either a correcting moment of a weight used as a keel, or by the use of ailerons controlled by a roll sensor. Usually, the tow cable used for a towed body is not torque balanced and a slip joint connection between the towed body and the tow cable is not considered desirable as a water tight slip joint is expensive, complex, and likely to contaminate the acoustic sensor signals. A stabilizing device using a keel to correct for coarse rolling motion of an underwater towed body and horizontally moveable trim weight inside the towed body to correct for the finer rolling motion is described in our copending patent application filed with the same filing date as that of subject patent application. That arrangement is suitable for a tow cable which is not excessively torque unbalanced. For tow cables that twist excessively under load, that device does not work very well. There is thus a need for a stabilizing device which can compensate for large rolling motions of the towed body due to the torque of the tow cable.

SUMMARY OF THE INVENTION

A stabilizing device to compensate for the rolling motion of an underwater towed body according to the teachings of subject invention allows the towed body to experience unchecked rolling motion so as to allow the towed body to reach an equilibrium position without applying any corrective counter torque to the towed body. This is achieved by an internally movable keel weight. The body is deployed with the keel weight located at the center of rotation. The body can rotate relieving the tow cable torque almost completely, as there is no resisting moment. After allowing the body to rotate, relieving the torque, the weight is extended providing a moment to rotate the body to near vertical position. Thus the acoustic sensor mounted on the top of the body is looking upward. Although the small displacement of the keel weight does not result in a large moment, it is effective as there is almost no torque left in the cable to be resisted.

An object of subject invention is to correct for rolling motion of a towed body.

Another object of subject invention is to provide means for correcting the coarse and fine rolling motions of the towed body.

Still another object of subject invention is to provide a simple and effective device for correcting coarse and fine rolling motions of the towed body.

Other objects, advantages and novel features of the invention may become apparent from the following detailed description of the invention when considered in conjunction with the accompanying drawings wherein:

DESCRIPTION OF THE PREFERRED EMBODIMENT

Figure 1:
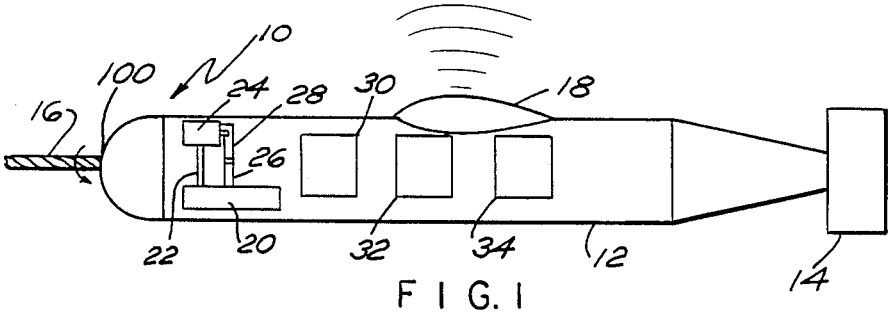
FIG. 1 is a block diagram of a towed body and the stabilizing device according to the teachings of subject invention.
Figure 2:
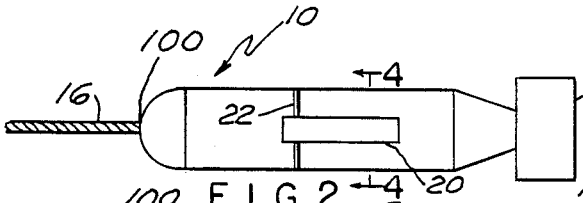
FIG. 2 is a schematic representation of the towed body with the vertically moveable keel weight of the stabilizing device located along the axis of the towed body (retracted)
Figure 4:
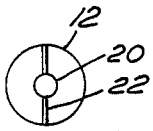
FIG. 4 is a semi-cross sectional view of FIG. 2 taken along line 4—4.
Figure 3:
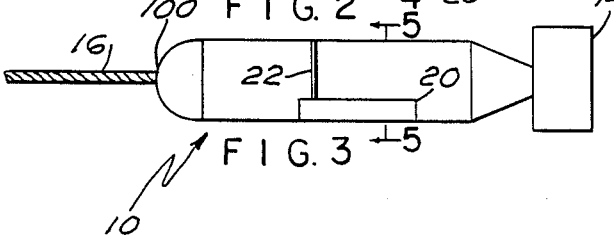
FIG. 3 is a schematic representation of the towed body with the vertically moveable keel weight of the stabilizing device located at its lowest vertical position (extended)
Figure 5:
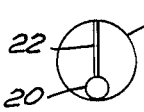
FIG. 5 is a semi-cross sectional view of FIG. 3 taken along line 5—5.
Figure 6:
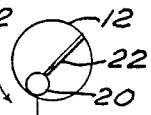
FIG. 6 represents a representation of the towed body wherein keel weight is in a slightly different position from that of FIG. 5 showing how its rolling motion reducing torque is applied.
Figure 7:
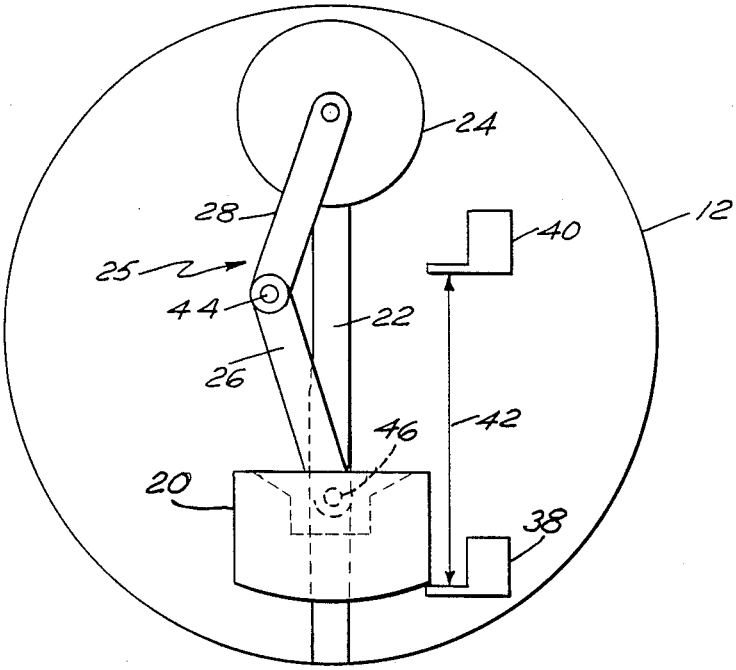
FIG. 7 is a magnified view depicting the vertical motion of the weight inside the towed body.

Referring to the drawings wherein like reference characters designate identical or corresponding parts throughout the several figures and more particularly to FIG. 1 thereof, a stabilizing device 10 according to the teachings of subject invention is shown in a block diagram form. Towed body 12 has tail section 14 and is being towed by means of tow cable 16 and a connection means 100. An acoustical sensor 18 is secured to the top of the towed body so that it looks upward. It also has a keel weight 20 which is moveable vertically along guide bars 22. The vertical motion of the keel weight 20 is controlled by electric motor 24 which is connected to weight 20 by means of a drive mechanism 25 including connecting rod 26 and crankshaft 28. The towed body also includes electronics module 30 and a roll-, pitch-, and depth-sensor 32 to monitor the various parameters of the towed body. It also has a control electronics package 34 which includes voltage regulator and generates timing signals for a transmitter and limit control signals for weight moving motor 24. FIG. 2 shows a side view of the towed body wherein vertically moveable keel weight 20 is shown to be located in the center along the axis of the towed body 12. FIG. 3 shows towed body 12 with keel weight 20 located in the fully extended position as shown FIG. 3, 5, and 7. The towed body is allowed to experience rolling motion due to the imbalanced torque of the tow cable 16. After rolling over as many times as is necessary to relieve the tow cable torque, the towed body 12 is stabilized. The acoustic transducer 18 may wind up looking in any direction. The keel weight is then extended so as to rotate the towed body 12 so that the acoustic sensor 18 is looking upward. The weight 20 is moved by powering a crank shaft and connecting rod mechanism 25 driven by an electric motor 24 with a built-in gear reducer. The retracted and extended positions of the keel weight are controlled by limiting switches 40 and 38 respectively separated by vertical distance 42. FIG. 6 shows a different position of keel weight 20 from that of FIG. 5. Drive mechanism 25 is shown in a detailed form in FIG. 7 wherein connecting rod 26 and crankshaft 28 are connected with crank pin 44 and connecting rod 46 is connected to keel weight 20 by wrist pin 46.

In operation, when rolling motion of the towed body is caused by highly imbalanced tow cable torque, it rotates freely because it is directly tied to the tow cable as shown in FIGS. 1–3.

After rotation of the towed body reaches equilibrium, the keel weight 20 is then extended by providing power to the keel weight motor 24. The keel weight 20 will then rotate the body 12 to the desired position where the acoustic sensor 18 will be looking upward. The rolling motion sensor sends the roll information to the surface via the tow cable. Electronic package 34 provides power for the acoustic sensor which includes a transmitter and a receiver.

Briefly stated, a stabilizing device for a towed body to correct for the rolling motion caused by the torque of the towed cable includes a vertically moveable keel weight which compensates for a finer adjustment of the position of the towed body. The finer adjustment of the towed body is accomplished after it is allowed to rotate freely under the imbalanced torque of the tow cable. The electric motor extending the keel weight receives its power from an electronic package, energized from the surface ship. The rolling motion sensor permits monitoring of the rolling motion on the surface ship. It should be understood that the words used for the preferred embodiment described above are not to be construed as limitations but they should be considered as words of description.

Many modifications and variations are possible to practice subject inventive concept without deviating from the teachings of subject invention. For example, the shape and position of the keel can be varied. Furthermore, the design of the rolling motion sensor can also vary. It is therefore understood that within the scope of the appended claims, the invention may be practiced otherwise than specifically described.

What is claimed is:

1. A stabilizing device for a body towed by a tow cable against the rolling motion thereof caused by an imbalanced torque in the tow cable, said stabilizing device includes:

connection means for allowing said towed body to roll freely due to imbalanced torque of the tow cable and thus correcting against major portion of the imbalanced torque in the tow cable;

an extendable keel weight housed inside said towed body for providing a righting torque on the towed body to make the acoustic sensor look upward; and means for moving said movable keel weight in response to said residual rolling motion of said towed body.

2. The stabilizing device of claim 1 which further includes a motor means for moving to the keel weight to compensate for the remaining portion of the imbalanced torque for the undesired rolling motion of said towed body.

3. The stabilizing device of claim 2 which also includes a rolling motion sensor to measure the rolling motion of the towed body.

4. The stabilizing device of claim 3 which further includes limiting means to limit the motion of said keel weight in the upward and downward directions.

5. A method for stabilizing a body being towed by a tow cable by means of vertically movable keel weight by a motor means which comprises the steps of:

providing for rotation of said towed body under the influence of the imbalanced torque of the tow cable; and applying power to said motor means for moving said keel weight to compensate for the residual undesired rolling motion of the towed body.

6. The method of claim 5 which further includes the step of limiting the vertical motion of said keel weight.

* * * * *